US007572049B2

(12) United States Patent
Hiranuma

(10) Patent No.: US 7,572,049 B2
(45) Date of Patent: Aug. 11, 2009

(54) TIMEPIECE

(75) Inventor: Haruki Hiranuma, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 12/150,721

(22) Filed: Apr. 30, 2008

(65) Prior Publication Data

US 2008/0285391 A1 Nov. 20, 2008

(30) Foreign Application Priority Data

May 2, 2007 (JP) ..... 2007-121513

(51) Int. Cl.
*G04B 37/00* (2006.01)

(52) U.S. Cl. ..... 368/295

(58) Field of Classification Search ..... 368/294–296
See application file for complete search history.

(56) References Cited

U.S. PATENT DOCUMENTS

| | | | | |
|---|---|---|---|---|
| 3,271,945 | A * | 9/1966 | Anderson | 368/22 |
| 5,122,997 | A * | 6/1992 | Schneider et al. | 368/294 |
| 5,319,617 | A * | 6/1994 | Sonoda | 368/294 |
| 5,541,895 | A * | 7/1996 | Nussbaum | 368/295 |
| 6,200,019 | B1 * | 3/2001 | Latini | 368/289 |
| 6,821,014 | B2 * | 11/2004 | Hiranuma et al. | 368/295 |
| 2003/0099165 | A1 * | 5/2003 | Terasawa | 368/294 |
| 2003/0123332 | A1 * | 7/2003 | Hiranuma et al. | 368/295 |
| 2005/0013204 | A1 * | 1/2005 | Hiranuma et al. | 368/295 |
| 2005/0141347 | A1 * | 6/2005 | Takeda | 368/295 |

OTHER PUBLICATIONS

Patent Abstracts of Japan, Publication No. 11-118951, Publication Date Apr. 30, 1999.

* cited by examiner

*Primary Examiner*—Vit W Miska
(74) *Attorney, Agent, or Firm*—Adams & Wilks

(57) ABSTRACT

To provide a timepiece in which operations for a rotation stop of a bezel and its release are easy, and reliability and a durability of the rotation stop are high. A bezel is disposed in a bezel disposition part of a case band so as to be capable of rotation-operating, and positioning parts and lock parts, which comprise plural concave-convex portions juxtaposed in a direction of the rotation, are formed in a back face of the bezel. To the case band, there is attached a clip stop mechanism (positioning means), which permits clockwise and counterclockwise rotations of the bezel by engaging with and disengaging from the positioning part, and holds the bezel in a position in which the rotation of the bezel is stopped. Between the case band and the back face of the bezel, a lock member is disposed so as to be movable in a diameter direction of the case band. The member has operation convex parts, pushing-in-operated from an outer periphery side of the bezel, a holding groove (holding part), and a stopper part inserted to and retracted from the lock part. To the case band, there is attached a click stop mechanism (holding means) engaging with the holding groove when the lock member was moved to a position in which the stopper part engages with the lock part, thereby holding the lock member.

20 Claims, 10 Drawing Sheets

TIMEPIECE

BACKGROUND OF THE INVENTION

1. Field of the Invention

The present invention relates to a timepiece, such as watch, which has a bezel rotation-operated.

2. Description of the Related Art

There is known a timepiece in which there is made such that the bezel arbitrarily rotation-operated by a user does not move carelessly from its rotated position (e.g., refer to JP-A-11-118951 Gazette (Paragraphs 0025-0051, FIG. 1-FIG. 5)).

In the timepiece of the JP-A-11-118951 Gazette (Paragraphs 0025-0051, FIG. 1-FIG. 5), the bezel is disposed so as to be rotatable while surrounding a cover glass installed in a case band, a regulation protrusion provided in an inner periphery of this bezel is engaged from a lower side with a regulation protrusion provided in an outer periphery of a site surrounding the cover glass of the case band, the bezel is held to the case band so as not to be removed in an upward direction, and a threaded part is formed in a lower part outer periphery of the site surrounding the cover glass. And, between the case band and the bezel, a threaded ring engaging with a threaded part is disposed so as to be capable of being rotation-operated.

According to this timepiece of the JP-A-11-118951 Gazette (Paragraphs 0025-0051, FIG. 1-FIG. 5), by the fact that the threaded ring is separated from a lower face of the bezel by rotation-operating the threaded ring, a rotation operation of the bezel is permitted. Reversely to this, by the fact that the bezel is pushed up by rotation-operating the threaded ring in a reverse direction to thereby be pushed to the lower face of the bezel, it is possible to fix the bezel to the case band by mutually butting the above regulation protrusions.

In the prior art, by a frictional force between the threaded ring and the bezel lower face and a frictional force between the both regulation protrusions of the case band and the bezel, since the bezel is fixed so as not to rotate, it is unavoidable that, just before this fixation completes, a rotation operation force of the threaded ring is exerted on the bezel and this becomes gradually large. By this, such a fear is high that the bezel is rotated in conjunction with the threaded ring which is rotation-operated, and deviates from a desired position.

Additionally, in the prior art, since the threaded ring is rotation-operated, not only it is inconvenient in the operation, and, since the user judges the fact that the bezel became a fixed state by the fact that the rotation operation of the treaded ring became heavy, this judgment is liable to disperse. By this, there is a possibility that an excess or deficiency occurs in the fixation of the bezel, and also a possibility that the threaded ring loosens is high.

Moreover, in the prior art, a pushing-up force, of the threaded ring, for fixing the bezel is received by the both regulation protrusions of the case band and the bezel. Since these regulation protrusions are small and their strengths are low, such a probability is high that, by a force exerted as the bezel is repeatedly fixed, the both regulation protrusions deform and a reliability suitably fixing the bezel lowers.

SUMMARY OF THE INVENTION

It is an aspect of the present invention to provide a timepiece in which operations for a rotation stop of the bezel and its release are easy, and reliability and a durability of the rotation stop are high.

A timepiece concerned with the aspect of the present invention possesses a case band in which there is formed a bezel disposition part surrounding a cover glass; a bezel which is disposed in the bezel disposition part so as to be capable of rotation-operating in regard to the case band, and in which there are formed a positioning part comprising plural concave-convex portions juxtaposed, in a direction of the rotation, in a back face opposing to a bottom face of the bezel disposition part, and a lock part comprising plural concave-convex portions juxtaposed in the direction of the rotation; a positioning means which is attached to the case band, which permits clockwise and counter clockwise rotations of the bezel, which is elastically engaged with and disengaged from the positioning part such that, when the rotation of the bezel is stopped, the bezel is held in that position; a lock member which is disposed between the case band and a back face of the bezel so as to be movable in a diameter direction of the bezel, and which has operation convex parts alternately pushing-in-operated from an outer periphery side of the bezel for this movement, a stopper part inserted to and retracted from the lock part following upon the movement, and a holding part; and a holding means attached to the case band so as to be engaged with and disengaged from the holding part, and elastically engaging with the holding part when the lock member is moved to a position in which the stopper part engages with the lock part to thereby hold the lock member.

In the present invention, it is desirable that the plural concave-convex portions forming the positioning part of the bezel and the plural concave-convex portions forming the lock part of the bezel are provided with their positions being coincided such that the convex portions and the concave portions are mutually juxtaposed in a radial direction of the bezel. However, the convex portion or the concave portion of the positioning part and the concave portion or the convex portion of the lock part may be provided with their positions being deviated in a rotation direction of the bezel, e.g., such that the convex portion or the concave portion of the positioning part and the concave portion or the convex portion of the lock part are mutually juxtaposed in the radial direction of the bezel.

In the present invention, the positioning means has a locking part besides one explained in later-mentioned embodiments, and permits a passing of the convex portion by the fact that, at clockwise and counterclockwise rotation times, the locking part is pushed to the convex portion of the positioning part and elastically deforms, and it is also possible to use a leaf spring holding the bezel by the fact that, when the rotation of the bezel is stopped in a desired position, the locking part enters to the concave portion of the opposed positioning part by an elastic force.

In the present invention, although it is desirable that the lock member is an annular shape in a site excluding the operation convex part, if it has a strength of a degree not bending when the operation convex part is pushed, the above site may form a non-annular shape such as approximate C-letter shape for instance. In the present invention, the stopper part of the lock member can be formed by one protrusion engaging with the lock part by being inserted to one concave portion of the lock part and, besides this, it is also possible to form it by plural protrusions engaging with the lock part so as to nip at least one convex portion of the lock part by being inserted to adjoining plural concave portions of the lock part, in other words, by one or more groove(s) fitted to at least one convex portion of the lock part, which is formed between these protrusions.

In the present invention, the holding means has a locking part besides one explained in later-mentioned embodiments, and elastically deforms with the locking part being pushed at a movement time of the lock member, and it is also possible to use a leaf spring holding the lock member by engaging with the holding part of the bezel by an elastic force when the movement of the lock member is stopped. Further, in the present invention, the holding part of the lock member may be a hole besides one explained in later-mentioned embodiments, or it can be formed by an elastically deformable cut-up piece provided such that one part of the lock member is protruded from a back face of this member and, as to a tip part of this cut-up piece, there suffices if a sectional shape along the movement direction of the lock member is formed like a semicircular arc. In this case, there suffices if the holding means is formed by a groove opening to the bottom face of the bezel disposition part.

In the timepiece of the present invention, in order to rotate the bezel, there suffices if, first, by moving the lock member in a diameter direction of the bezel by pushing-in one operation convex part of the lock member in one-touch operation, there is made a state in which a rotation of the bezel is permitted by removing the stopper part from the lock part of the bezel, and thereafter the bezel is rotated till a desired position by a hand finger. In this case, since the positioning means repeats an elastic engagement/disengagement with/from the positioning part of the bezel, a moderation feeling is given to the rotation of the bezel. And, at a time point reaching to a desired, rotated position, the positioning means engages with the concave portion of the positioning part, thereby rotation-stopping the bezel. When the bezel is being rotated, since the positioning means permits the clockwise and counterclockwise rotations, even if the rotation of bezel falsely exceeds, it is possible to easily dispose the bezel to the desired, rotated position by performing an operation rotating it in a reverse direction without a necessity for additionally rotating the bezel by approximate one rotation.

And, under this state, by the fact that, by pushing-in the other operation convex part of the lock member in one-touch operation, the lock member is moved in the diameter direction of the bezel in a direction reverse to the case of the pushing-in, it is possible to insert the stopper part of this lock member to the lock part of the bezel and engage with the same, and the holding means elastically engages with the holding part of the lock member and thus the lock member is held to the case band. By this, notwithstanding the fact that the positioning means is not one regulating the rotation operation of the bezel in one direction, the bezel can be fixed such that the bezel is not rotated carelessly by a non-intended force and the like.

Like the above, following upon the fact that the lock member is moved in the diameter direction of the bezel, since the rotation stop of the bezel and its release are born by inserting and retracting the stopper part of the lock member to and from the lock part in a bezel back face, there is no fact that the bezel is carelessly rotated by the fact that a torque is given to the bezel when this bezel is rotation-stopped. Together with this, in comparison with a case where the bezel is fixed by rotating the lock member, operations for the rotation stop of the bezel and its release are easily performed. Additionally, following upon the fact that the lock member moves in the diameter direction of the bezel in order to rotation-stop the bezel, since there is no portion deforming by undergoing an excessive force, even if a rotation stop of the bezel is repeatedly performed in a long term use, there is no fear that the reliability and the durability of the rotation stop are impaired. Moreover, when the lock member is disposed in a position in which the bezel is rotation-stopped, since the holding means elastically engages with the holding part of the lock member to thereby give the moderation feeling, the fact that the bezel was rotation-stopped is easily perceived, so that there can be made such that the rotation stop of the bezel does not become insufficient.

In a desirable mode of the present invention, an annular bezel holder holding an outer periphery part of the bezel from a front side is fixed to the case band, a guide groove is provided in a position corresponding to a diameter direction of the bezel holder, and the operation convex part is inserted to the guide groove and made protrusible from the bezel holder.

In this desirable mode, by the bezel holder, it is possible to hold the bezel so as not to be removed from the case band and, by sliding the operation convex part to the guide groove of this bezel holder, it is possible to limit a movement of the lock member to the diameter direction of the bezel.

In a desirable mode of the present invention, the operation convex part protruded from the bezel holder is disposed in a 12 o'clock-6 o'clock direction.

In this desirable mode, since a pushing-in operation of the operation convex part can be made without being hindered by a crown protruded from a periphery face of the case band ordinarily in a 3 o'clock direction, and the like, it is excellent in an operation ability for the rotation stop of the bezel and its release.

In a desirable mode of the present invention, mutually different displays are applied to each of the operation convex parts.

One operation convex part is protruded from the bezel holder under a rotation stop state of the bezel, and the other operation convex part is protruded from the bezel holder under a state in which the rotation stop of the bezel was relieved. Therefore, in this desirable mode, a user visually confirms the display of the operation convex part protruded from the bezel holder and can grasp a state of the lock member. Accordingly, it is useful in a point that the bezel being rotation-stopped is suppressed from being falsely rotation-operated, and also in a point confirming the fact that the rotation stop of the bezel by the lock member was performed.

In a desirable mode of the present invention, the positioning part and the lock part are continuously formed along a radial direction of the bezel.

In this desirable mode, since the positioning part and the lock part are continuous, in a case where these are made by a press die, a structure of the press die becomes simple, so that a die cost can be reduced and, further in a case where the positioning part and the lock part are made by a cutting, since it is possible to simultaneously cut them and a working cost can be reduced, it is desirable.

In a desirable mode of the present invention, the positioning means is formed by a first click member comprising a spherical body and engaged with and disengaged from the positioning part, and a biasing body for a click, which rotatably supports this first click member and pushes it to the back face of the bezel.

In this desirable mode, following upon the rotation operation of the bezel, since the first click member comprising the spherical body elastically deforms the biasing body for the click while accompanying a rotation to thereby permit a passing of the positioning part, of the bezel, comprising concave-convex portions, the rotation of the bezel can be smoothly made, and it is desirable in suppressing a local abrasion-of the first click member.

In a desirable mode of the present invention, the holding part is formed by a groove or a hole, opening to a back face of the lock member, and the holding means is formed by a second click member comprising a spherical body and engaged with and disengaged from the holding part, and a biasing body for holding, which rotatably supports this click member and pushes it to the back face of the lock member.

In this desirable mode, following upon a movement operation of the lock member, since the second click member comprising the spherical body elastically deforms the biasing body for holding while accompanying a rotation to thereby be engaged with and disengaged from the holding part of the lock member, a movement start of the lock member is smooth, and it is desirable in suppressing the local abrasion of the second click member.

In a desirable mode of the present invention, in the lock member there is provided other holding part which is formed by a groove or a hole, opening to the back face of the lock member, and with which the holding means is engaged when the lock member is moved to a position in which the stopper part is separated from the lock part.

In this desirable mode, by the fact that the holding means is engaged with other holding part provided in the lock member, it is possible to give the moderation feeling when the lock member was moved to a position in which the stopper part was separated from the lock part, and it is possible to hold the lock member to the above separated position so as not to backlash.

In a desirable mode of the present invention, the positioning part and the positioning means are provided near an inner periphery of the bezel, and the lock part and the holding means are provided near an outer periphery of the bezel.

In this desirable mode, in comparison with a case where the lock part and the holding means are provided near the inner periphery of the bezel, since there is no fact that a device escaping the positioning means is required in the lock member, it is desirable in a point that a structure is simple.

In a desirable mode of the present invention, a back face cover part covering a back face of the operation convex part protruded from the bezel holder is monolithically provided in the case band.

In this desirable mode, since the operation convex part protruded from the bezel holder is guarded by the back face cover such that an object does not impinge from a back side of the operation convex part, it is possible to suppress a false operation in which the operation convex part is carelessly pushed-in, and thus the lock member is moved.

In a desirable mode of the present invention, side face cover parts covering both-side faces of the operation convex part protruded from the bezel holder are monolithically provided in the bezel holder.

In this desirable mode, since the operation convex part protruded from the bezel holder is guarded by the side fate cover part such that the object does not impinge from a direction other than its backside and upper side, it is possible to suppress the false operation in which the operation convex part is carelessly pushed-in, and thus the lock member is moved.

According to the present invention, it is possible to provide the timepiece in which operations for the rotation stop of the bezel and its release are easy, and the reliability and the durability of the rotation stop are high.

DESCRIPTION OF THE PREFERRED EMBODIMENTS

By referring to FIG. 1-FIG. 7, there is explained a first embodiment of the present invention.

Figure 2B:
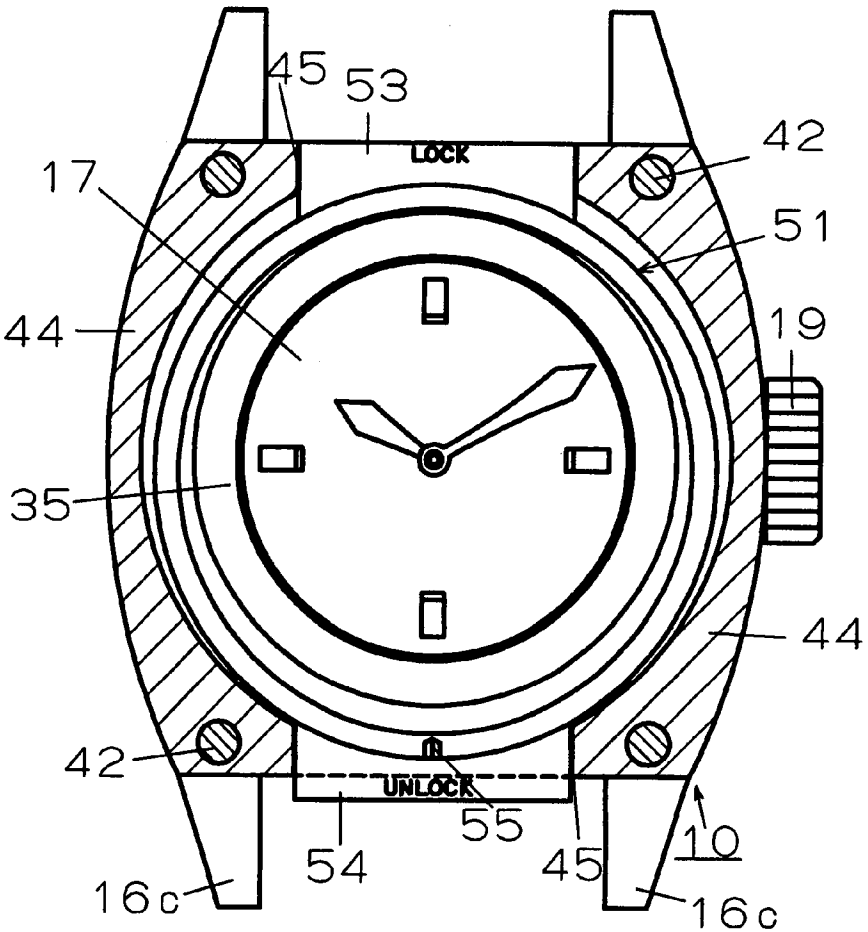
FIG. 2B is a front view showing the wristwatch of FIG. 2A under the state in which the bezel holder that this timepiece possesses was sectioned.
Figure 2A:
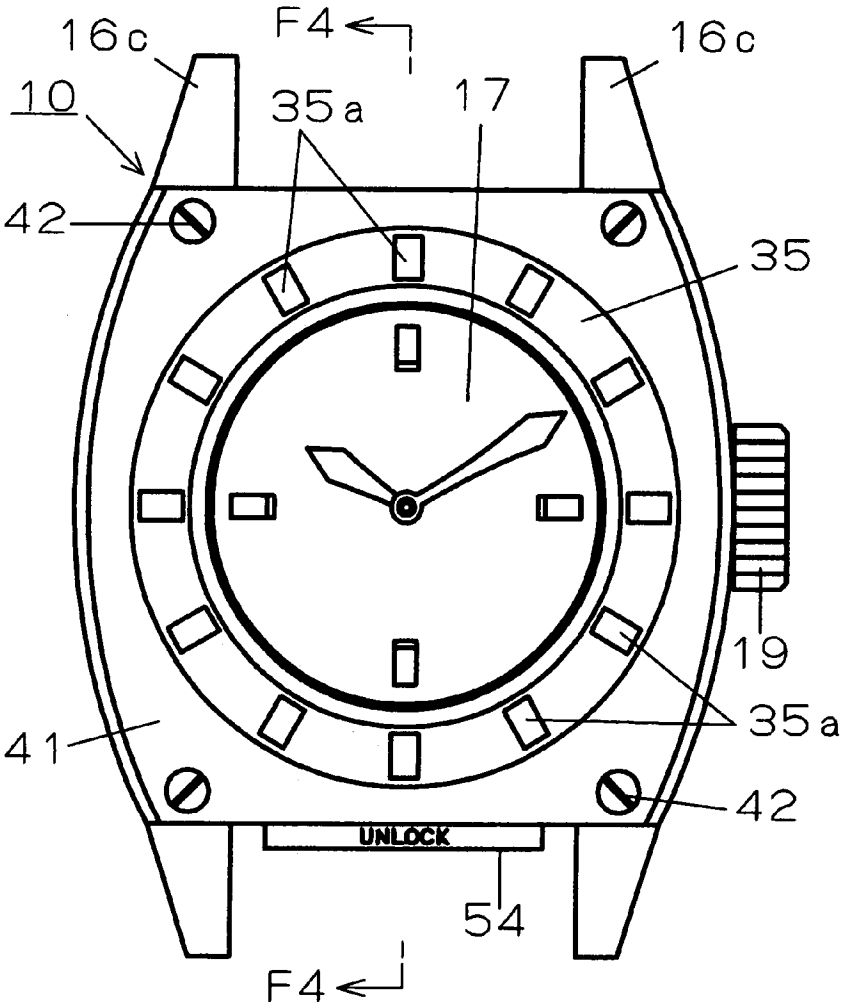
FIG. 2A is a front view showing the wristwatch concerned with the first embodiment of the present invention, under a state in which a rotation of the bezel that this timepiece possesses was permitted.
Figure 3:
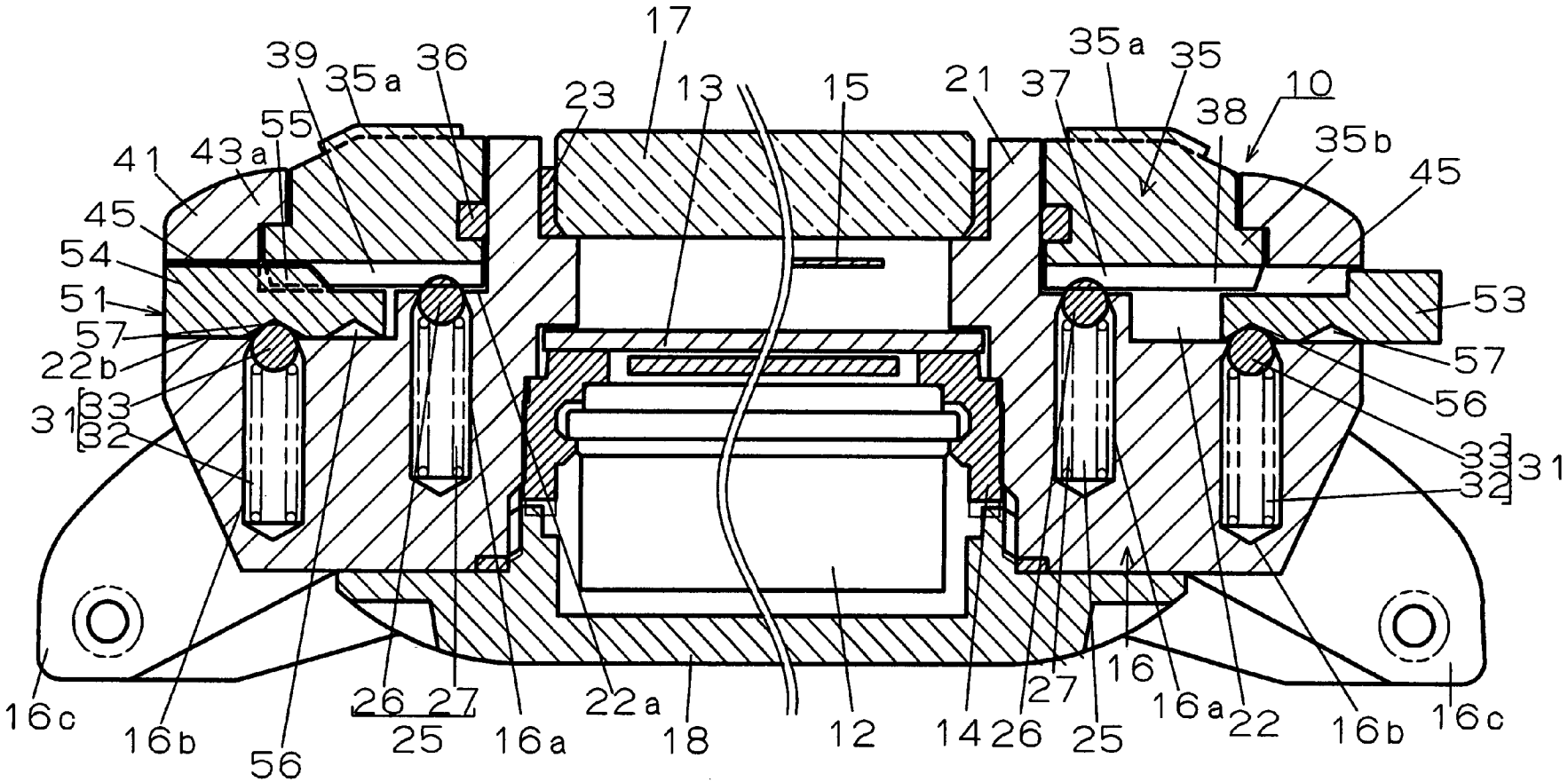
FIG. 3 is a sectional view of the wristwatch, which shows along an F3-F3 line in FIG. 1A.
Figure 4:
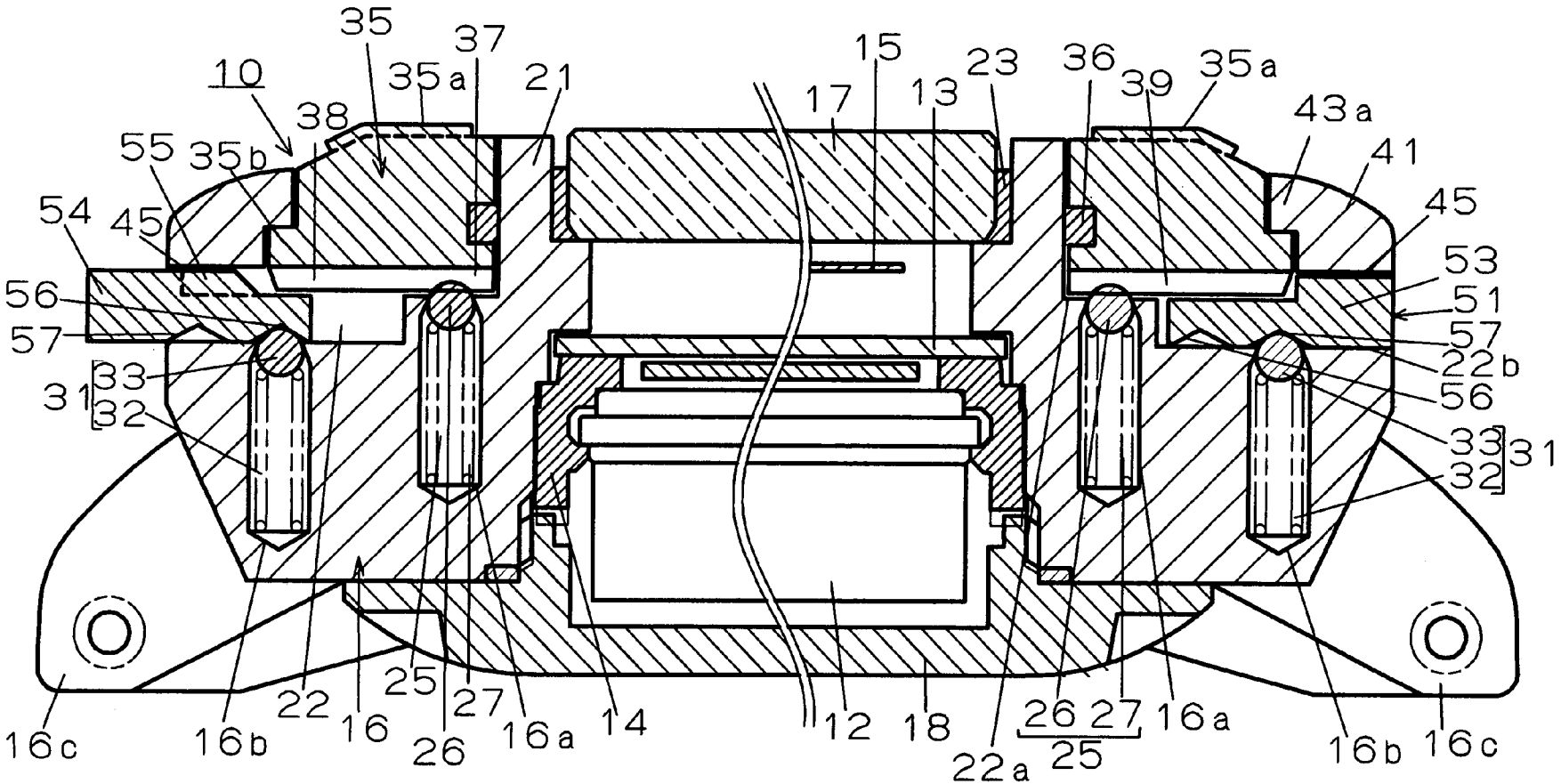
FIG. 4 is a sectional view of the wristwatch, which shows along an F4-F4 line in FIG. 2A.

In FIG. 1-FIG. 4, a reference numeral 10 shows a watch, e.g., wristwatch. As shown in FIG. 3 and FIG. 4, in a timepiece armor assembly that this wristwatch 10 possesses, there are accommodated a timepiece movement 12, a dial 13, a casing ring 14, and the like. The dial 13 is attached to the timepiece movement 12. The timepiece movement 12 drives a display hand 15 opposing to the dial 13. The casing ring 14 supports the timepiece movement 12 to the timepiece armor assembly.

As shown in FIG. 3 and FIG. 4, the timepiece armor assembly possesses a case band 16, a cover glass 17, and a case back 18. The case band 16 is like an annulus, and desirably made of a metal. The cover glass 17 is fluid-tightly mounted while closing an opening in one face (front face) side in a thickness direction of the case band 16. The dial 13 and the display hand 15 are viewable through this cover glass 17. The case back 18 is fluid-tightly mounted while closing an opening in the other face (back face) side in the thickness direction of the case band 16. Incidentally, a reference numeral 19 in FIG. 1 and FIG. 2 shows a crown.

The case band 16 has in its front side a cylindrical annular convex part 21 protruding in a front face (upward) direction, and a bezel disposition part 22 surrounding this annular convex part 21. In an inside of the annular convex part 21, the cover glass 17 is mounted through a ring-shaped gasket 23. In order to simplify a working of the annular convex part 21, a diameter of an outer periphery face of this annular convex part 21 is made the same in each part, and a protrusion for preventing a later-mentioned bezel from being removed, and the like are not provided.

A bottom face of the bezel disposition part 22 comprises a first bottom face 22*a* and a second bottom face 22*b*, which continue through a step. The first bottom face 22*a* continues approximately, perpendicularly to a lower end of the annular convex part 21. The second bottom face 22*b* is provided around the first bottom face 22*a* at lower position than the first bottom face. By these step-like bottom faces and an outer periphery face of the annular convex part 21, there is partitioned the bezel disposition part 22 opened respectively to an upper part and an outer periphery face of the case band 16.

As shown in FIG. 3 and FIG. 4, to the case band 16, there are attached a first click stop mechanism 25 forming at least one, e.g., one pair of, positioning means, and a second click stop mechanism 31 forming desirably one pair of holding means.

The first click stop mechanism 25 has a biasing body, e.g., a coil spring 27, for a click, and a first click member, e.g., a spherical body, desirably a steel ball 26. Incidentally, as this spherical body, it is also possible to use, other than the steel ball, a spherical body made of ceramics or synthetic resin. The coil spring 27 extends in the thickness direction of the case band 16, and is accommodated in a hole 16*a* opened to the first bottom face 22*a*. An open end of the hole 16*a* is diameter-reduced. The steel ball 26 is accommodated in the hole 16*a* so as not to be removed from the hole 16*a*, and rotatably supported to the coil spring 27. The coil spring 27 in the hole 16*a* is under a compression-deformed state and, by this, biases the steel ball 26 in such a direction that its one part protrudes from the first bottom face 22*a*.

The second click stop mechanism 31 is a constitution similar to the first click stop mechanism 25. That is, the second click stop mechanism 31 has a biasing body, e.g., a coil spring 32, for holding, and a second click member, e.g., a spherical body, preferably a steel ball 33. Incidentally, as this spherical body, it is also possible to use, other than the steel ball, the spherical body made of ceramics or synthetic resin. The coil spring 32 extends in the thickness direction of the case band 16, and is accommodated in a hole 16*b* opened to the second bottom face 22*b*. An open end of the hole 16*b* is diameter-reduced. The steel ball 33 is accommodated in the hole 16*b* so as not to be removed from the hole 16*b*, and rotatably supported to the coil spring 32. The coil spring 32 in the hole 16*b* is under the compression-deformed state and, by this, biases the steel ball 33 in such a direction that its one part protrudes from the second bottom face 22*b*.

One pair of first click stop mechanisms 25 are placed near an inner periphery of the case band 16, and disposed, e.g., in a 12 o'clock-6 o'clock direction of the wristwatch 10. Similarly, one pair of second click stop mechanisms 31 are placed near an outer periphery of the case band 16, and disposed, e.g., in the 12 o'clock-6 o'clock direction of the wristwatch 10. Accordingly, the first click stop mechanisms 25 and the second click stop mechanisms 31 are juxtaposed on a straight line connecting 12 o'clock-6 o'clock of the wristwatch 10.

In the bezel disposition part 22 of the case band 16, a bezel 35 is disposed so as to be capable of being rotation-operated. The bezel 35 is formed like an annulus by metal or synthetic resin, and an annular gasket 36 attached to an inner periphery of the bezel is rotatably fitted along an outer periphery face of the annular convex part 21 while being contacted with the outer periphery face of this annular convex part 21. Accordingly, the bezel 35 is disposed while surrounding the cover glass 17 and the dial 13.

In an upper face of the bezel 35, plural protrusions 35*a* for applying a finger, which become a clue when rotation-operating this bezel 35, are formed, e.g., in a circumferential direction at the same interval. Incidentally, in the upper face of the bezel 35, there is provided a bezel display (not shown in the drawing), such as numeral, becoming an aim of the rotation operation of this bezel 35.

The bezel 35 is a large diameter than the first bottom face 22*a* and, in its outer periphery, has an outer periphery convex part 35*b* continuing in the circumferential direction. A back face of the bezel 35 is opposed to the first bottom face 22*a* and the second bottom face 22*b*, which form a bottom face of the bezel disposition part 22, and, in this back face, there is provided an engaging part 39. This engaging part 39 is formed by plural concave-convex portions juxtaposed, e.g., continuously, in a direction along which the bezel 35 is rotated, and the respective concave-convex portions all extend in a radiation direction (radial direction) in regard to a center of the bezel 35. The number of the concave-convex portions is integer times of 60.

In the present embodiment, within the engaging part 39, a site near an inner periphery of the bezel 35, which is opposed to the first bottom face 22*a*, forms a positioning part 37 and, within the engaging part 39, a site near an outer periphery of the bezel 35, which is opposed to the second bottom face 22*b*, forms a lock part 38. And, the positioning part 37 formed by the plural concave-convex portions and the lock part 38 similarly formed by the plural concave-convex portions are continuously provided along the radial direction of the bezel 35. In other words, the convex portions and the concave portions of the positioning part 37 and the lock part 38 are provided with their positions being coincided so as to be mutually juxtaposed in the radial direction of the bezel 35.

Figure 7:
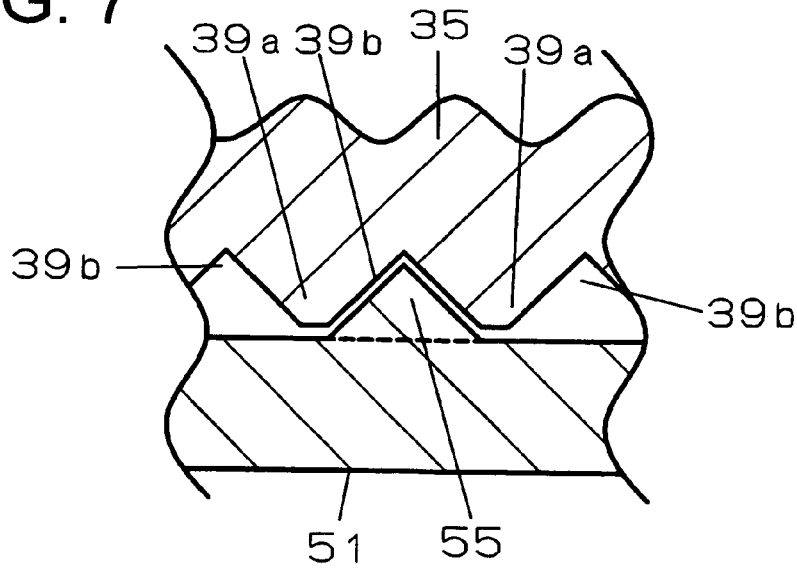
FIG. 7 is a sectional view showing an engaging place between the bezel and the lock member, that the wristwatch concerned with the first embodiment possesses.

As shown representatively by the lock part 38 in FIG. 7, a section of a downward convex portion 39*a* in a case where the positioning part 37 and the lock part 38 are sectioned along the circumferential direction of the bezel 35, and a section of a concave portion 39*b* opening to a back face of the bezel 35 all form an approximately triangular shape.

Figure 5:
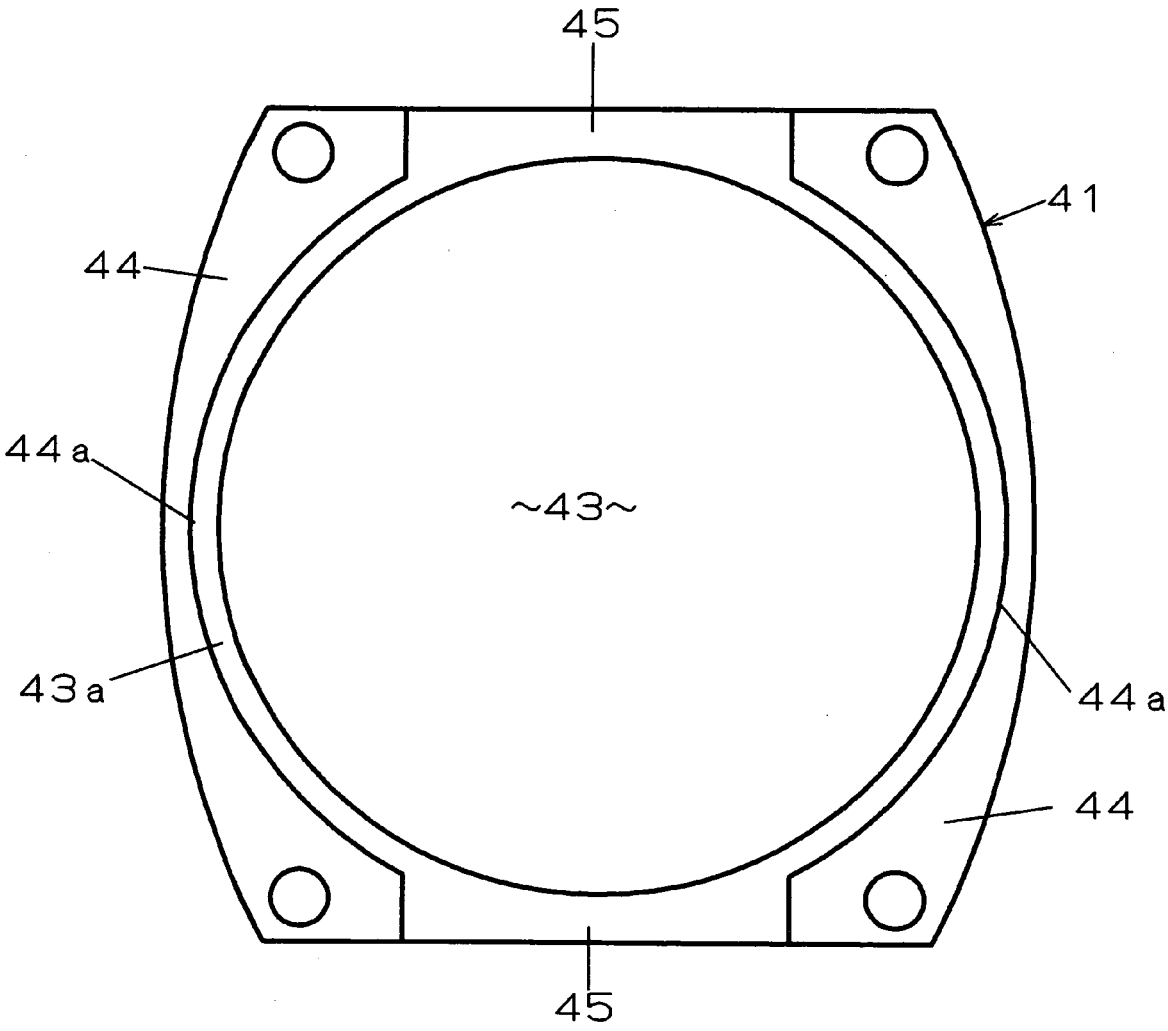
FIG. 5 is a back view showing the bezel holder that the wristwatch concerned with the first embodiment possesses.

A bezel holder 41 is fixed to a front side of the case band 16. The bezel holder 41 is made of metal or synthetic resin and, as shown in FIG. 5, has a through-hole 43, one pair of legs 44, and one pair of guide grooves 45.

One pair of legs 44 are formed around the through-hole 43 so as to extend in the 12 o'clock-6 o'clock direction of the wristwatch 10 and, in longitudinal direction both-end parts of these legs 44, the guide grooves 45 are respectively formed. Inside faces 44*a* of these legs 44 are formed like an arc for instance so as not to hinder a movement of a later-mentioned lock member 51 in order to escape a member main part 52 of this lock member 51.

The legs 44 of the bezel holder 41 are butted against the second bottom face 22*b*. By screwing screws 42 passing through the longitudinal direction both-end parts of these legs 44 into the case band 16, the bezel holder 41 is attached to the case band 16. By this attachment, an outer periphery part of the bezel 35 is held to the bezel holder 41.

Detailedly, a hole edge part 43*a* of the through-hole 43 is covered from above to an outer periphery convex part 35*b* of the bezel 35. In this case, the hole edge part 43*a* lightly contacts with the outer periphery convex part 35*b* so as not to become a rotation resistance at a rotation operation time of the bezel 35.

By the attachment of the bezel holder 41 to the case band 16, a site other than the outer periphery convex part 35*b* of the bezel 35 and the annular convex part 21 and the cover glass 17, which are placed in an inside of this bezel 35, are passed through the through-hole 43, and one pair of guide grooves 45 are disposed in the 12 o'clock-6 o'clock direction of the wristwatch 10.

Between the back face of the bezel 35 and the case band 16, the lock member 51 is disposed so as to be movable in the diameter direction of the case band 16, desirably the 12 o'clock-6 o'clock direction of the wristwatch 10. The lock member 51 comprises the metal or the synthetic resin and, as shown in FIG. 6 and the like, is formed in the member main part 52 formed desirably like a ring with one pair of operation convex parts 53, 54, a stopper part 55, a first holding groove 56 for instance as a holding part, and a second holding groove 57 as other holding part being provided.

The member main part 52 has a thickness approximately corresponding to an interstice between the back face of the bezel 35 and the second bottom face 22*b*, in other words, a height of a step forming a boundary between the first bottom face 22*a* and the second bottom face 22*b*. An inner diameter of the member main part 52 formed like the ring is larger than a diameter of the step forming the boundary between the first bottom face 22*a* and the second bottom face 22*b*. Within a range of this diameter difference, the member main part 52 is movable along the second bottom face 22*b*. An outer diameter of the member main part 52 is smaller than a maximum width of the second bottom face 22*b*, in which a 9 o'clock-3 o'clock direction of the wristwatch 10 is connected.

The operation convex parts 53, 54 monolithic with the member main part 52 are protruded outward from the member main part 52 while being mutually separated by 180 degrees. As to these operation convex parts 53, 54, their thicknesses and widths are approximately the same as a depth and a width of the above guide groove 45, and they are inserted to the guide grooves 45 disposed in the 12 o'clock-6 o'clock direction of the wristwatch 10, so as to be capable of sliding. Any one of the operation convex parts is protruded outward from the bezel holder 41 while penetrating through the guide groove 45, such that a pushing-in operation becomes possible.

Figure 6:
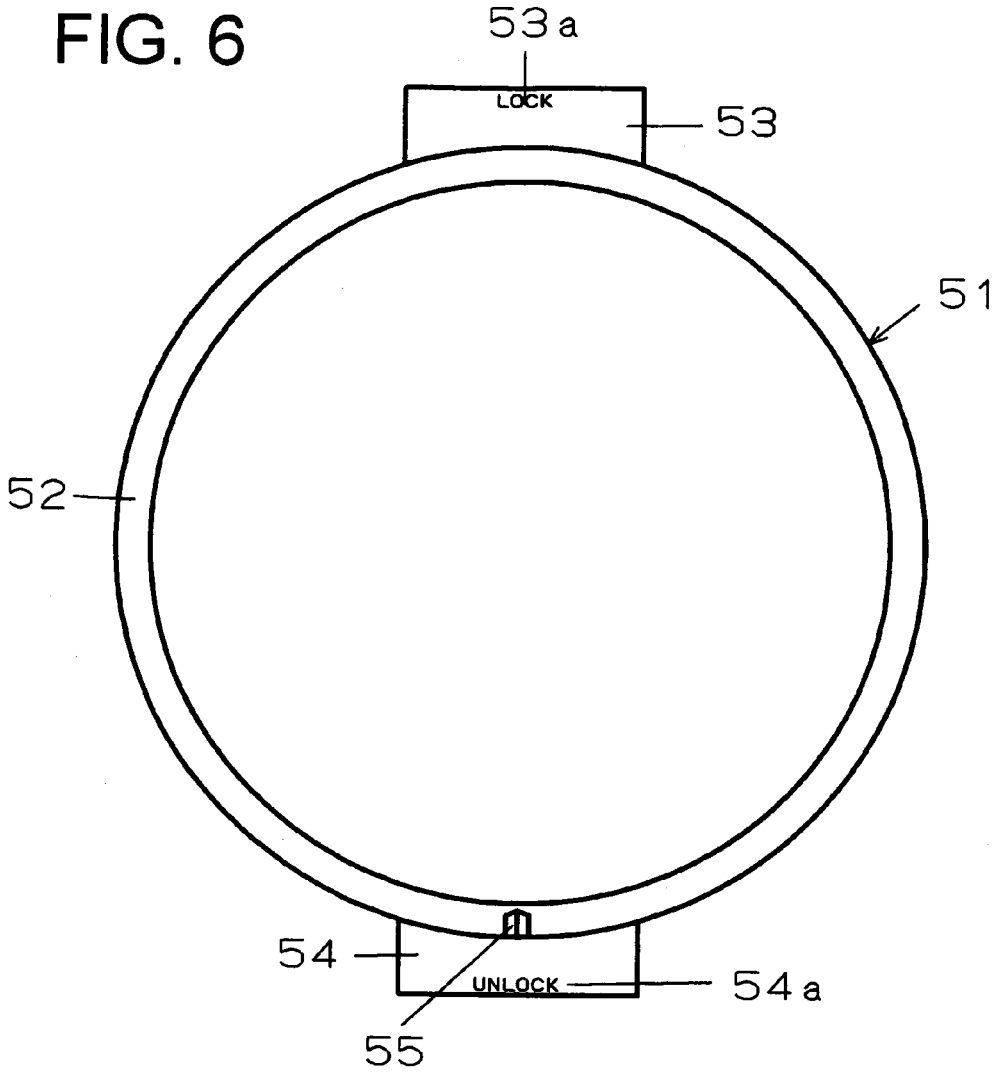
FIG. 6 is a plan view showing a lock member that the wristwatch concerned with the first embodiment possesses.

As shown in FIG. 6, to a surface of one operation convex part, e.g., the operation convex part 53 which is one placed in the 12 o'clock direction of the wristwatch 10, there is applied a letter that is "LOCK" for instance as a display 53*a*. Similarly, to a surface of the other operation convex part, e.g., the operation convex part 54 which is one placed in the 6 o'clock direction of the wristwatch 10, there is applied a letter that is "UNLOCK" for instance as a display 54*a*. Like this, by applying mutually different displays 53*a*, 54*a* to each of one pair of operation convex parts 53, 54, since there is made such that a state of the lock member 51 can be grasped by its visual confirmation, it is useful in suppressing a false rotation operation to the rotation-stopped bezel 35, and also in confirming the fact that the rotation stop of the bezel 35 by the lock member 51 was performed.

The stopper part 55 comprises a single protrusion inserted to and retracted from the concave portion 39*b* of the lock part 38 as the lock member 51 is moved in the 12 o'clock-6 o'clock direction of the wristwatch 10, and is monolithically, protrusively provided in an upper face of the member main part 52. A tip part of this stopper part 55 is formed in a taper toward an inside of the member main part 52 in order to smoothen the insertion to the concave portion 39*b*.

As shown in FIG. 3 and FIG. 4, in each of the back faces of sites of the member main part 52, which are placed in the 12 o'clock-6 o'clock direction of the wristwatch 10, there are respectively provided the first holding groove 56 and the second holding groove 57, which open to these back faces. Therefore, the first holding groove 56 and the second holding groove 57 are juxtaposed in the 12 o'clock-6 o'clock direction of the wristwatch 10. The first holding groove 56 is formed near an inner periphery of the member main part 52, and the second holding groove 57 is formed near an outer periphery of the member main part 52 than the first holding groove 56.

Next, there is explained an attachment procedure of the bezel 35 to the case band 16.

In regard to the case band 16 to which the first click stop mechanism 25 and the second click stop mechanism 31 were already attached, first, the lock member 51 is mounted on the second bottom face 22*b* of the bezel disposition part 22 in such a manner that one pair, of operation convex parts 53, 54 of the lock member are placed in the 12 o'clock-6 o'clock direction of the wristwatch 10. By this, the lock member 51 accommodates, in its through-hole 43, the step forming the boundary between the first bottom face 22*a* and the second bottom face 22*b*, and is disposed such that the member main part 52 of the lock member 51 makes a detour around this step.

After this, the bezel 35 to whose inner periphery there was attached the annular gasket 36 is fitted to the outer periphery of the annular convex part 21 of the case band 16, thereby disposing this bezel 35 to the bezel disposition part 22 of the case band 16. Next, the bezel holder 41 is covered to the outer periphery part of the bezel 35 while accommodating any of the operation convex parts 53, 54 to each of the guide grooves 45 of the bezel holder and, thereafter, this bezel holder 41 is fixed to the case band 16 by the screws 42.

Finally, in a case where the operation convex part 54 of one to which the display 54*a* was applied is protruded to an outside of the bezel holder 41, by pushing-in this operation convex part 54, the lock member 51 is moved such that the operation convex part 53 of one to which the display 53*a* was applied protrudes to the outside of the bezel holder 41.

Figure 1B:
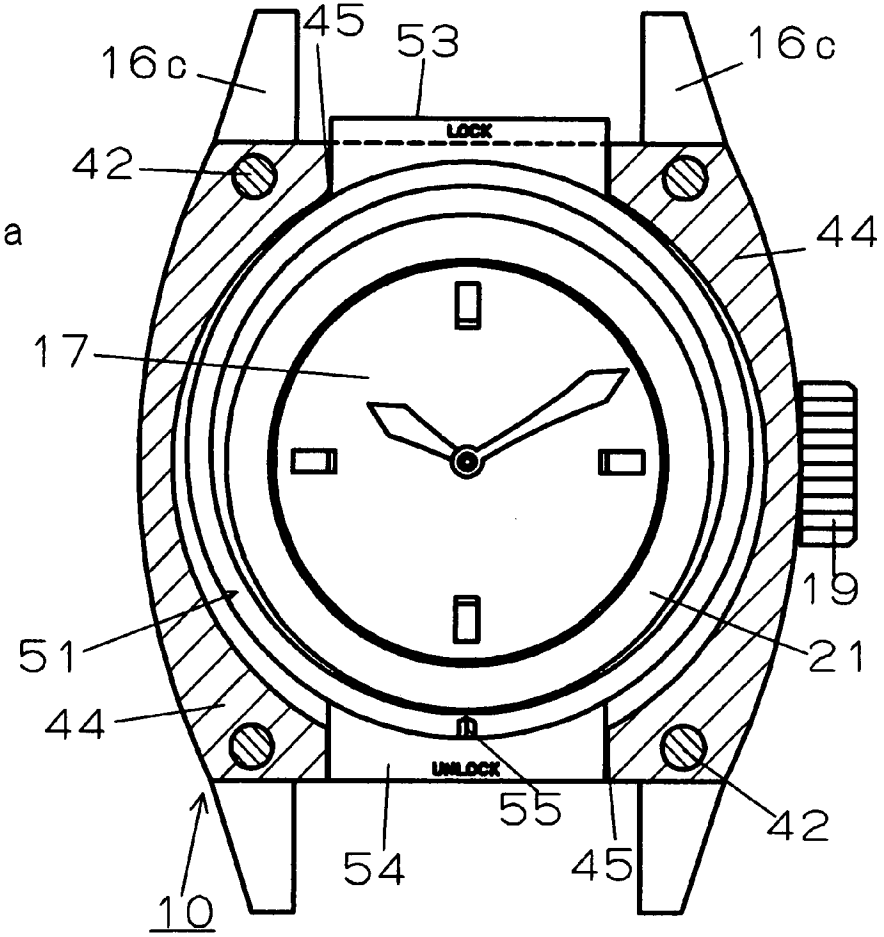
FIG. 1B is a front view showing the wristwatch of FIG. 1A under a state in which a bezel holder that this timepiece possesses was sectioned.
Figure 1A:
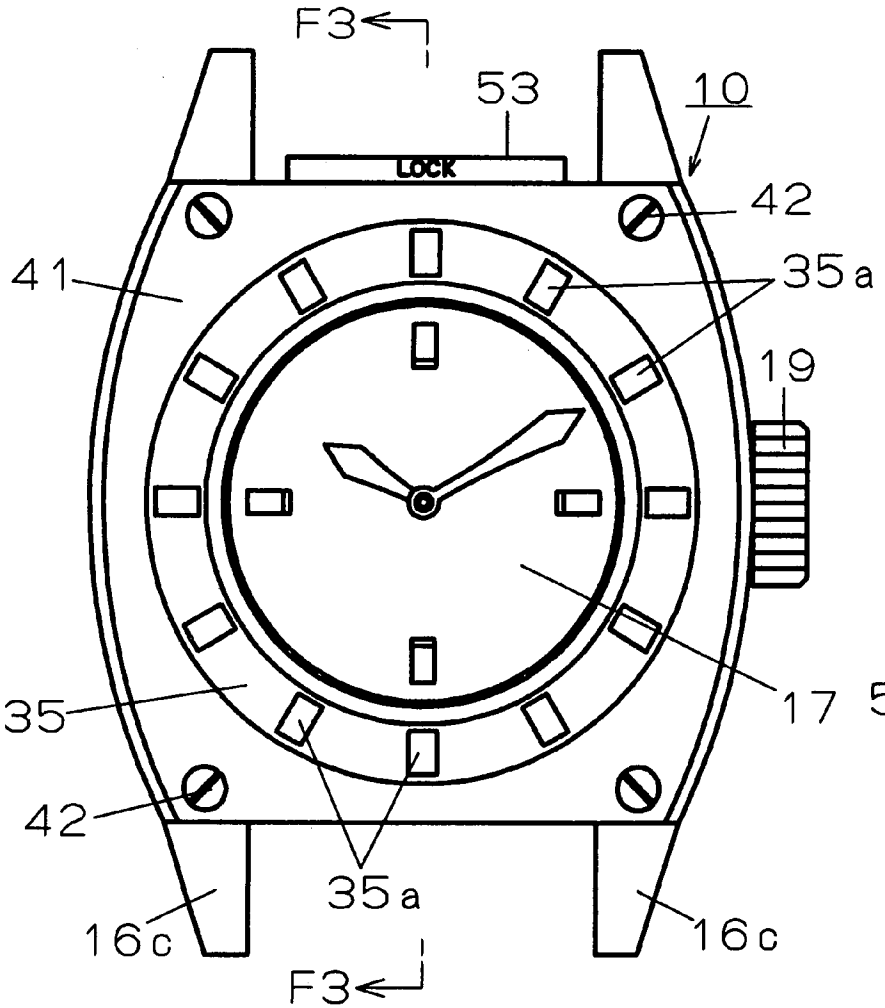
FIG. 1A is a front view showing a wristwatch concerned with a first embodiment of the present invention, under a state in which a bezel that this timepiece possesses was rotation-stopped.

By this, an attachment of the bezel 35 to the case band 16 is completed. This assembly completed state is shown in FIG. 1A, FIG. 1B and FIG. 3. Under this state, since the steel balls 26 in one pair of first click stop mechanisms 25 are pushed to the back face of the bezel 35 and engage while entering to the concave portion 39*b* of the positioning part 37 of this bezel 35 from a back side of the bezel 35, the bezel 35 is held in a stationary state. Together with this, since the stopper part 55 of the lock member 51 is inserted to the concave portion 39*b* of the lock part 38 of the bezel 35 from an outer periphery side of this bezel 35 and engages with the convex portion 39*a* of the lock part 38 as shown in FIG. 7, the bezel 35 is rotation-stopped.

Moreover, under this state, the lock member 51 is held in the stationary state by the second click stop mechanism 31. In other words, the steel ball 33 of the second click stop mechanism 31 placed in a 12 o'clock side of the wristwatch 10 is pushed to the back face of the lock member 51 and, in the first holding groove 56 and the second holding groove 57 which are provided in the operation convex part 53 side of the lock member 51, engages with the first holding groove 56 while entering from a back side of the lock member 51. Similarly, the steel ball 33 of the second click stop mechanism 31 placed in a 6 o'clock side of the wristwatch 10 is pushed to the back face of the lock member 51 and, in the first holding groove 56 and the second holding groove 57 which are provided in the operation convex part 54 side of the lock member 51, engages with the second holding groove 57 while entering from the back side of the lock member 51.

Accordingly, like the above, under an ordinary use state in which the bezel 35 was rotation-stopped by using the lock member 51, even if a torque is exerted on the bezel 35, there is no fact that this bezel 35 is carelessly rotated. Further, since the operation convex part 53 of one to which the display 53*a* of the lock member 51 was applied is protruded to the outside of the bezel holder 41, the user can visually confirm the fact that the bezel 35 exists in a turn-stopped state (lock state) Next, there is explained a procedure rotating the bezel 35.

First, the operation convex part 53 protruding from the bezel holder 41 is pushed-in in the 6 o'clock direction of the wristwatch 10 in one-touch operation, thereby moving the lock member 51. This movement is performed while accompanying click stop operations of one pair of second click stop mechanisms 31.

In other words, in relations between the first holding groove 56 and the second holding groove 57 which are placed in the 12 o'clock side of the wristwatch 10 and the second click stop mechanisms 31 in places corresponding to the formers, following upon a movement start of the lock member 51, since the steel ball 33 of the second click stop mechanism 31 separates from the first holding groove 56 by being pushed down while compressing the coil spring 32 and opposes to the second holding groove 57 when subsequently the lock member 51 is moved by a predetermined quantity, the steel ball 33 engages while elastically entering to the second holding groove 57 by an elastic force of the coil spring 32.

Simultaneously with this, also in relations between the first holding groove 56 and the second holding groove 57 which are placed in the 6 o'clock side of the wristwatch 10 and the second click stop mechanisms 31 in places corresponding to the formers, following upon the movement start of the lock member 51, since the steel ball 33 of the second click stop mechanism 31 separates from the second holding groove 57 by being pushed down while compressing the coil spring 32 and opposes to the first holding groove 56 when subsequently the lock member 51 is moved by the predetermined quantity, the steel ball 33 engages while elastically entering to the first holding groove 56 by the elastic force of the coil spring 32.

By the above click stop operations, the user can obtain the moderation feeling. As shown in FIG. 2A, FIG. 2B and FIG. 4, under this state, the operation convex part 53 of the lock member 51 enters to the bezel holder 41, and the operation convex part 54 having the display 54*a* that is "UNLOCK" is protruded to the outside of the bezel holder 41. Accordingly, by the above moderation feeling, an engaging sound generated following upon the former, and the visual confirmation of the display 54*a*, the user can easily perceive the fact that the lock member 51 was suitably moved to an unlock position from a lock position.

Following upon the above movement of the lock member 51, since its stopper part 55 is separated from the concave portion 39*b* of the lock part 38, with which it engaged till then, a rotation stop function of the bezel 35 by the lock member 51 is lost.

Next, the bezel 35 is rotated till it reaches to a desired, rotated position by applying the finger to its protrusion 35*a*. Following upon this rotation, since there is performed a click stop operation in which the steel ball 26 of the first click stop mechanism 25 repeats an intermittent engagement with the positioning part 37, it is possible to continuously obtain the moderation feeling. Together with this, since the first click stop mechanism 25 is not one limiting the rotation operation of the bezel 35 to one direction, when the rotation of the bezel 35 exceeded, the bezel 35 can be easily coincided with the desired, rotated position by being operated such that the rotation direction of the bezel 35 becomes reverse, without additionally rotating this bezel 35 by approximate one rotation. And, the bezel 35 which reached to the desired, rotated position is held in the stationary state by an engagement of the steel ball 26 of the first click stop mechanism 25 with the positioning part 37 of the bezel.

Moreover, as shown in FIG. 4, an inner periphery side back face of the bezel 35 adjoins the first bottom face 22*b*, and an outer periphery side back face of the bezel 35 adjoins two places of the member main part 52 of the lock member 51, in other words, positions, corresponding to the diameter direction. Therefore, in the rotation operation of the bezel 35, the bezel 35 is suppressed from slanting to the annular convex part 21, so that it is possible to easily rotate the bezel 35.

Finally, the operation convex part 54 protruding from the case band 16 is pushed-in in the 12 o'clock position of the wristwatch 10 in one-touch operation, thereby moving the lock member 51 while accompanying the click stop operation of the second clips top mechanism 31. By this, as already mentioned, since the stopper part 55 of the lock member 51 is inserted to the concave portion 39*b* of the lock part 38 of the bezel 35 from an outer periphery side of this bezel 35 and engages with the lock part 38, the bezel 35 is rotation-stopped.

Together with this, as shown in FIG. 1A, FIG. 1B and FIG. 3, there is disposed such that the operation convex part 54 of the lock member 51 enters to the bezel holder 41, and the operation convex part 53 having the display 53*a* that is "LOCK" protrudes from the outer periphery of the case band 16. Also in this case, by the moderation feeling by the click stop operation of the second click stop mechanism 31, the engaging sound generated following upon the former, and the visual confirmation of the display 53*a*, the user can easily perceive the fact that the lock member 51 was suitably moved to the lock position from the unlock position. By this, since there can be made such that the movement of the lock member 51 does not become incomplete, there can be made such that the rotation stop of the bezel 35 does not become insufficient.

As explained above, in the wristwatch 10 of the above constitution, when rotating the bezel 35, the operation convex parts 53, 54 are alternately pushing-in-operated in order to cause the lock member 51 to perform one reciprocation. And, by this pushing-in, following upon the fact that the lock member 51 is moved in the 12 o'clock-6 o'clock direction of the wristwatch, which is the diameter direction of the bezel 35, by inserting and retracting the stopper part 55 to and from the lock part 38 in the back face of the bezel 35, the rotation stop of the bezel 35 and its release are born. Therefore, when the bezel 35 is rotation-stopped, since there is no fact that the torque is given to the bezel 35, there is no fear that this bezel 35 is carelessly rotated and the bezel 35 deviation-moves from the desired, rotated position.

And, in comparison with a case where the bezel 35 is rotation-stopped while accompanying the rotation operation, since operations for the rotation stop of the bezel 35 and its release can be performed by the pushing-in-operation of the lock member 51 in one-touch, the operation is simple.

Additionally, there is no portion which deforms by undergoing an excessive force following upon the fact that the lock member 51 is moved in the diameter direction of the bezel 35 in order to rotation-stop the bezel 35. Therefore, even if the rotation stop of the bezel 35 is repeatedly performed in the long term use, there is no fear that the reliability and the durability of the rotation stop are impaired. Accordingly, since it is unnecessary to form, in the outer periphery face of the annular convex part 21 of the case band 16 and the inner periphery face of the case band 16, a protrusion for removal-stopping the bezel 35, a working becomes easy.

Incidentally, in a case where, although the bezel holder 41 is used, a removal stop of the bezel 35 is not performed by this bezel holder 41, it is also possible to carry out the removal stop by forming a protrusion for removal-stopping the bezel 35 in an outer periphery face of the annular convex part 21, and forming the protrusion engaging with the former protrusion from a lower side in an inner periphery of the bezel 35.

In the above wristwatch 10, the annular bezel holder 41 holding the outer periphery convex part 35*b* of the bezel 35 from the front side (upper side) is fixed to the case band 16, the guide grooves 45 are provided in positions corresponding to the diameter direction of this bezel holder 41, and the operation convex part 53 or 54 that the lock member 51 has is inserted to each of these guide grooves 45. By this, it is possible, by the bezel holder 41, to hold the bezel 35 so as not to be removed from the case band 16. Together with this, since the operation convex parts 53, 54 are slid to the guide grooves 45 of the bezel holder 41, it is possible to guide a movement of the lock member 51 so as to limit to the diameter direction of the bezel 35.

As mentioned already, since one pair of operation convex parts 53, 54 protruded from the bezel holder 41 are disposed in the 12 o'clock-6 o'clock direction, a mutual pushing-in operation of these operation convex parts 53, 54 can be made without being hindered by the crown 19 protruded from a periphery face of the case band 16 ordinarily in the 3 o'clock direction, and the like. Therefore, an ability of the operations of the lock member 51, which are made for the rotation stop of the bezel 35 and its release, is good.

Moreover, as shown in FIG. 3 and FIG. 4, the operation convex parts 53, 54 are placed above than bow feet 16*c* protruded slantingly downward from the case band 16. By this, in the pushing-in operation of the operation convex parts 53, 54, since the bow feet 16*c* and an arm wear member, such as band not shown in the drawing, connected to the formers are suppressed from becoming hindrances, an operation ability of the lock member 51 is good.

As mentioned already, the positioning part 37 and the lock part 38 are continuously formed in the back face of the bezel 35 along the radial direction of this bezel 35. Therefore, in the case where the positioning part 37 and the lock part 38 are made by the press die, the structure of the press die becomes simple, so that the die cost can be reduced. Further, in the case where the positioning part 37 and the lock part 38 are made by the cutting, since it is possible to simultaneously cut them, the working cost can be reduced.

As mentioned already, the first click stop mechanism 25 forming a positioning means of the bezel 35 is formed by the steel ball 26 forming a first click member, which is engaged with and disengaged from the positioning part 37 of the bezel 35, and the coil spring 27 as the biasing body for click, which pushes this steel ball 26 to the back face of the bezel 35 while rotatably supporting it. Therefore, following upon the rotation operation of the bezel 35, since the steel ball 26 elastically deforms the coil spring 27 while accompanying the rotation to thereby permit the passing of the positioning part 37, of the bezel 35, comprising the concave-convex portions, the rotation of the bezel 35 can be smoothly made, and it is possible to suppress the local abrasion of the steel ball 26.

Similarly, the second click stop mechanism 31 forming a holding means of the lock member 51 is formed by the steel ball 33 forming a second click member, which engages with and disengages from the first holding groove 56 and the second holding groove 57, which form holding parts, and the coil spring 32 as the biasing body for holding, which pushes this steel ball 33 to the back face of the lock member 51 while rotatably supporting it. Therefore, following upon the movement operation of the lock member 51, since the steel ball 33 elastically deforms the coil spring 32 while accompanying the rotation to thereby be engaged with and disengaged from the first holding groove 56 and the second holding groove 57 of the lock member 51, the movement start of the lock member 51 is smooth, and it is possible to suppress the local abrasion of the steel ball 33.

As mentioned already, in the lock member 51, there are provided the first holding grooves 56 and the second holding grooves 57, with which the steel balls 33 of one pair of second click stop mechanisms 31 engage, and the steel balls 33 are engaged with these holding grooves 56, 57 when the lock member 51 was moved to a position in which the stopper part 55 was separated from the lock part 38 of the bezel 35. By this engagement, it is possible to give the moderation feeling when the lock member 51 was moved to the position in which the stopper part 55 was separated from the lock part 38, and it is possible to hold the lock member 51 to the above separated position so as not to backlash.

Additionally, as mentioned already, the positioning part 37 and the first click stop mechanism 25 forming the positioning means are provided near the inner periphery of the bezel 35, and the positioning part 38 and the second click stop mechanism 31 forming the holding means are provided near the outer periphery of the bezel 35. Therefore, in comparison with a case where the lock part 38 and the second click stop mechanism 31 are provided near the inner periphery of the bezel 35, since there is no fact that a device escaping the first click stop mechanism 25 is required in the lock member 51, a structure is simple.

FIG. 8-FIG. 11 show a second embodiment of the present invention. This second embodiment is the same as the first embodiment except matters explained below. Therefore, about the same constitution as the first embodiment, there is applied the same reference numeral as the first embodiment, thereby omitting its explanation together with its action, and hereunder there are explained the matters different from the first embodiment.

Figure 8:
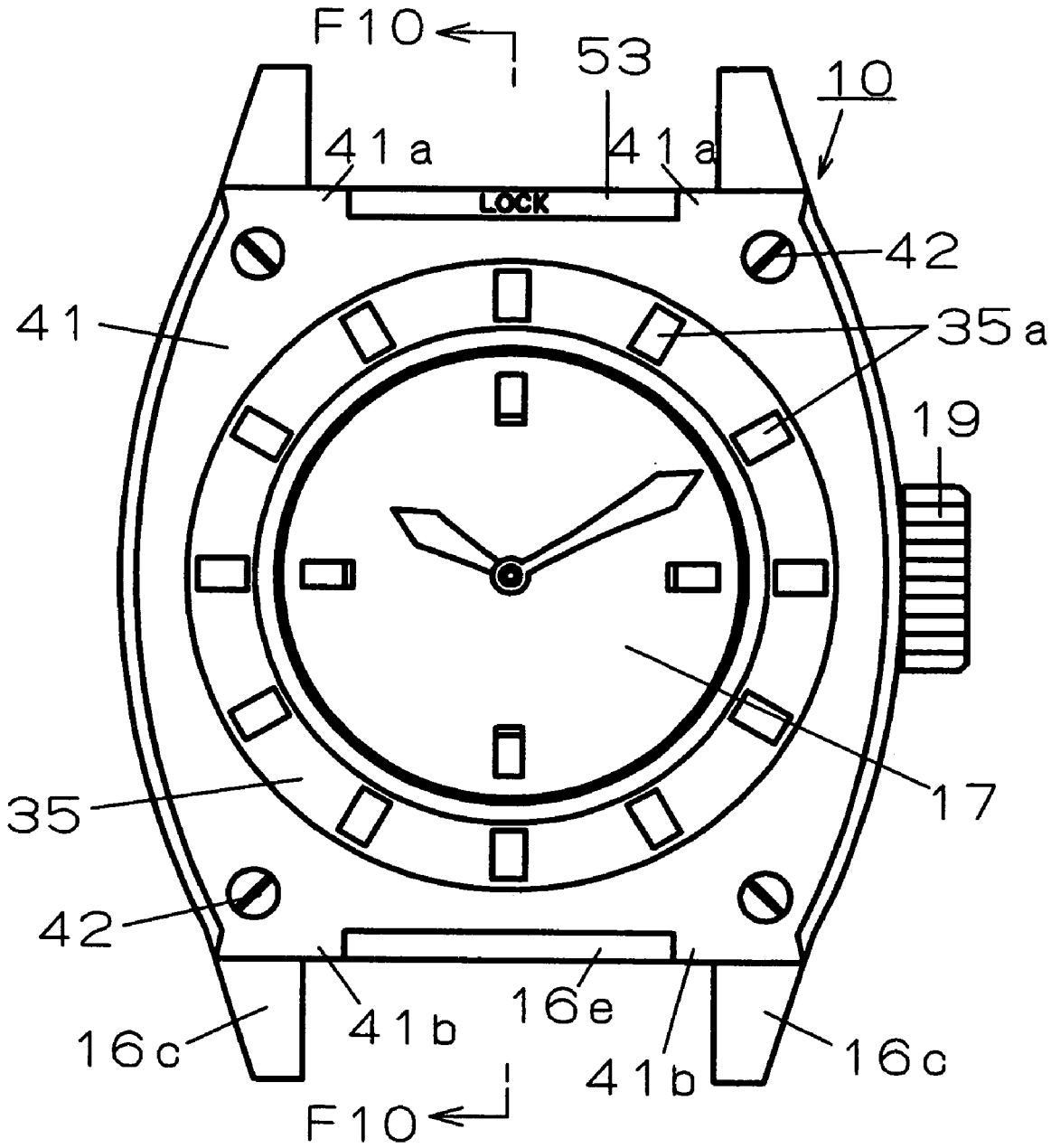
FIG. 8 is a front view showing a wristwatch concerned with a second embodiment of the present invention, under the state in which the bezel that this timepiece possesses was rotation-stopped.
Figure 9:
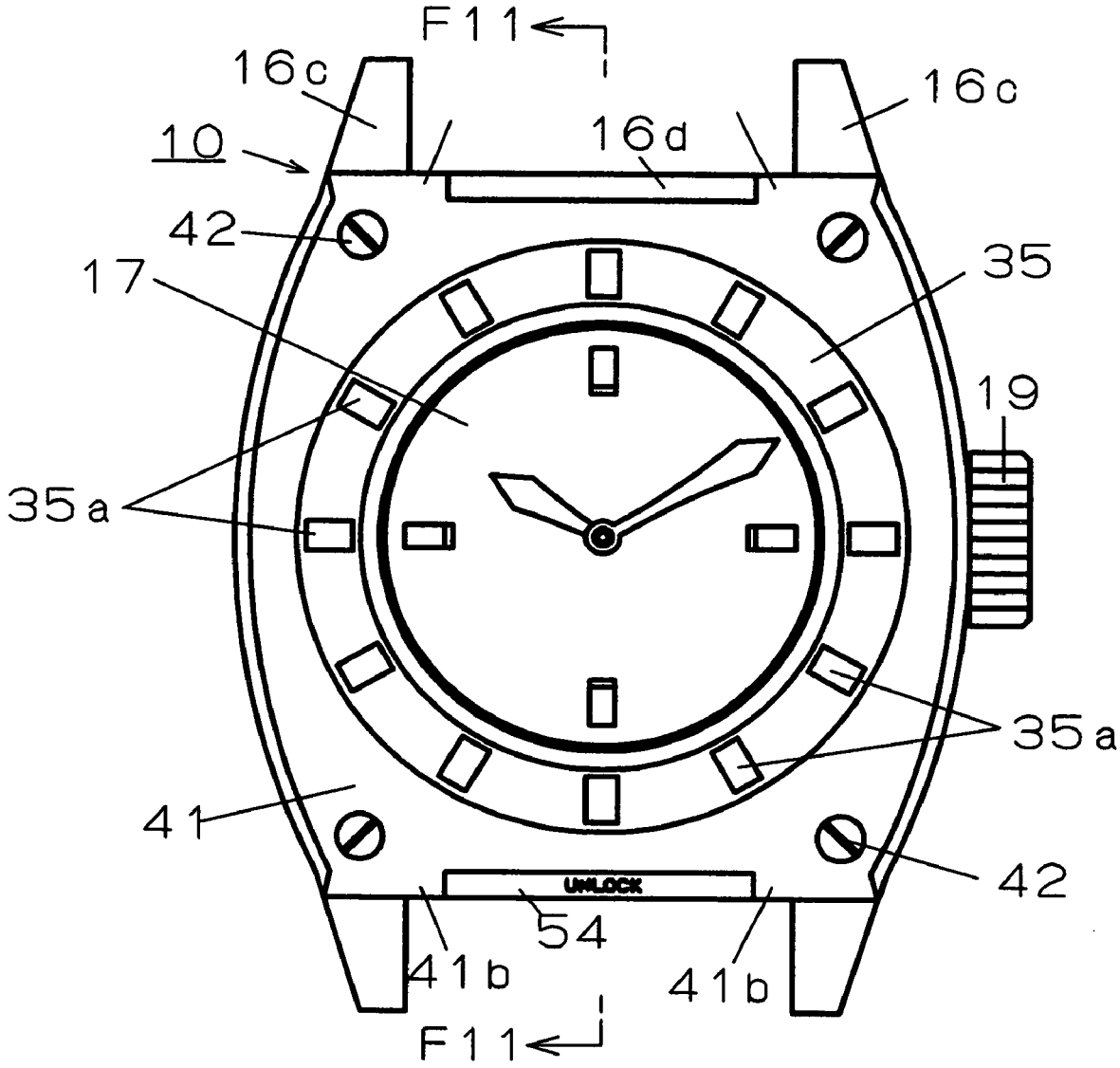
FIG. 9 is a front view showing the wristwatch concerned with the second embodiment, under the state in which the rotation of the bezel that this timepiece possesses was permitted.

In the second embodiment, back face cover parts 16*d*, 16*e* are monolithically provided in each of, e.g., the 12 o'clock side and the 6 o'clock side of the case band 16. These back face cover parts 16*d*, 16*e* extend along a direction perpendicularly intersecting with a straight line connecting the operation convex parts 53, 54 of the lock member 51, concretely the 9 o'clock-3 o'clock direction of the wristwatch 10 as shown in FIG. 8 and FIG. 9.

Figure 10:
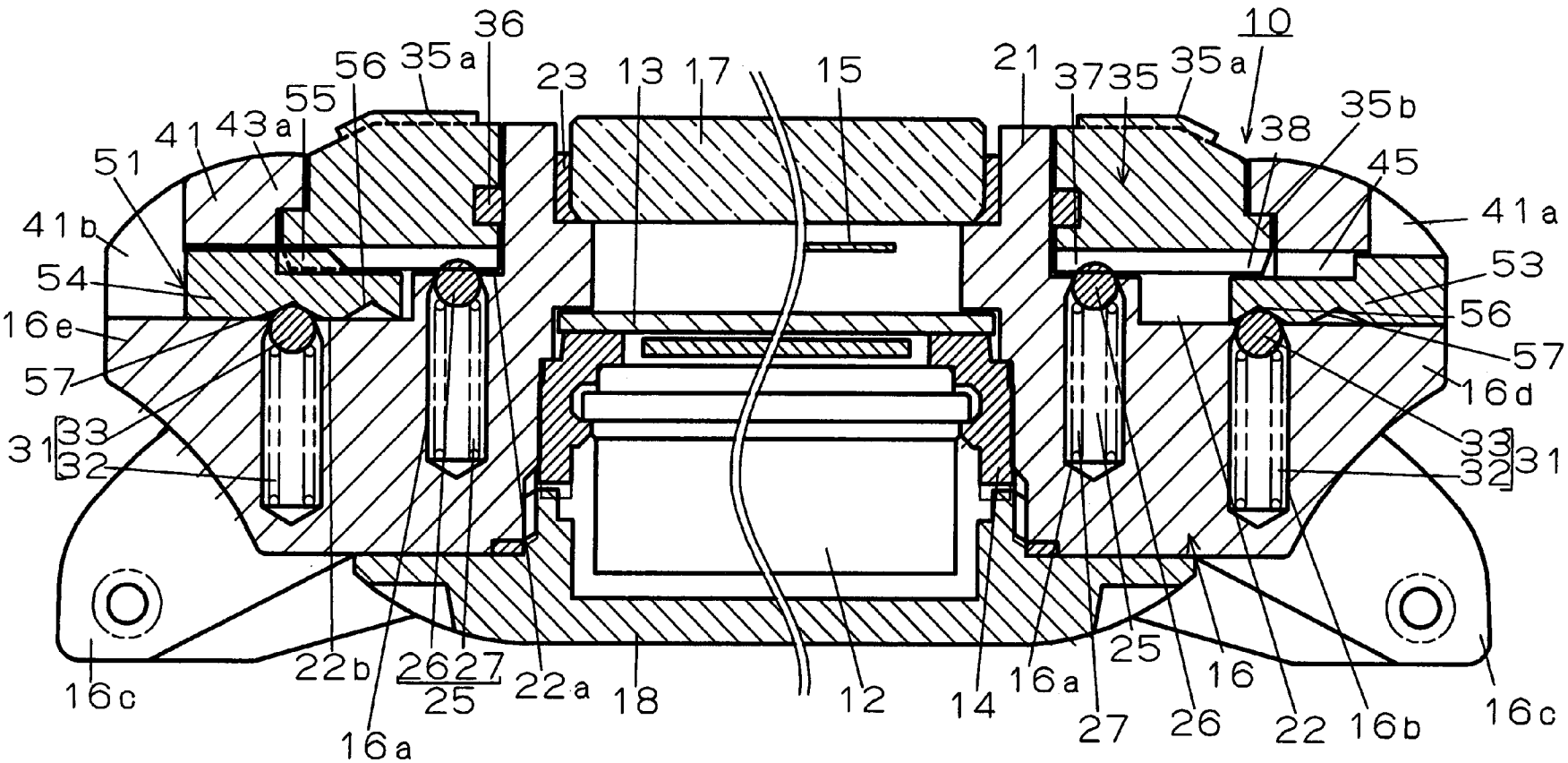
FIG. 10 is a sectional view of the wristwatch, which shows along an F10-F10 line in FIG. 8.
Figure 11:
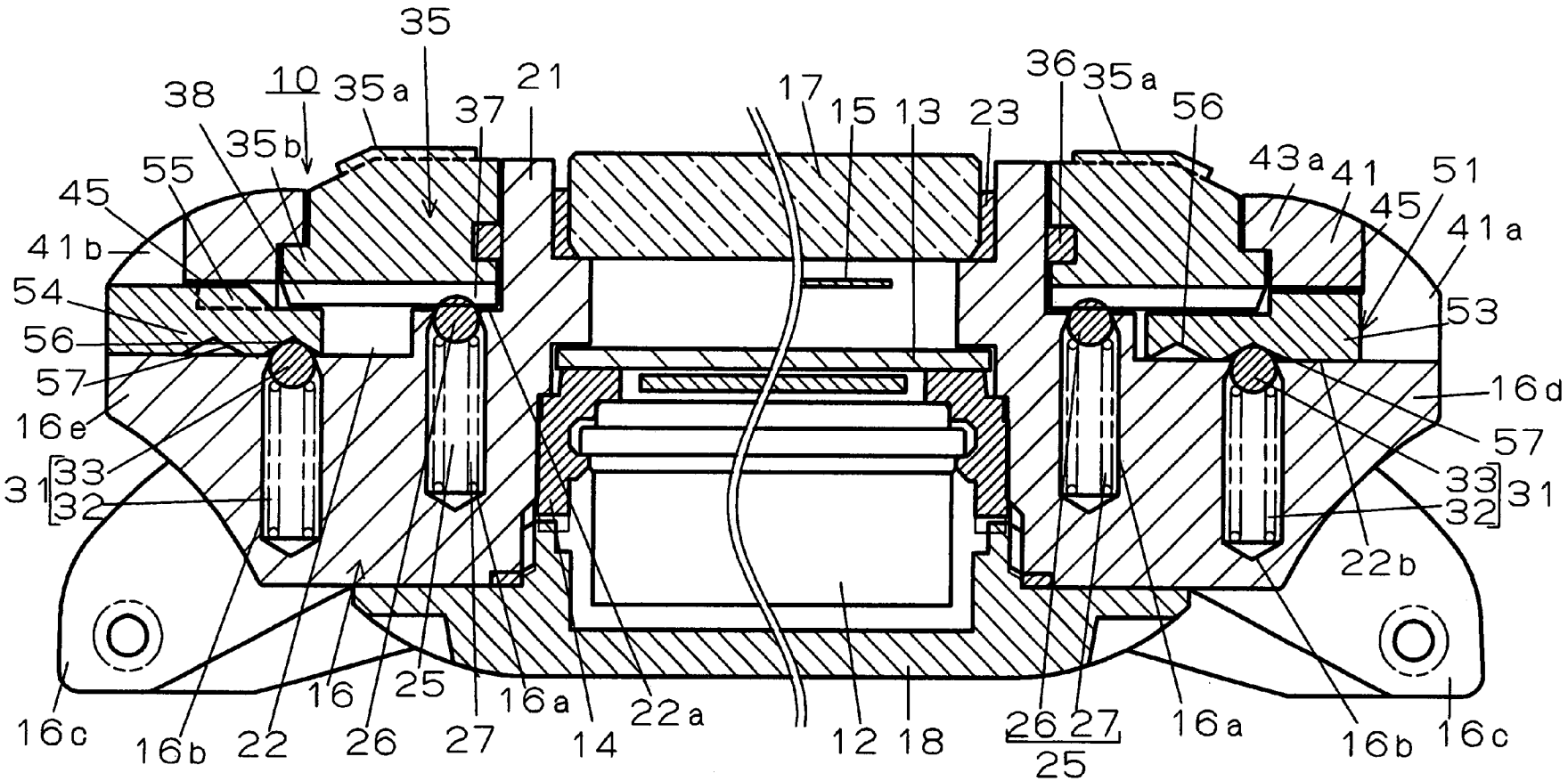
FIG. 11 is a sectional view of the wristwatch, which shows along an F11-F11 line in FIG. 9.

As shown in FIG. 10, the back face cover part 16*d* is provided so as to cover the back face, of the operation convex part 53 in the 12 o'clock side, which was protruded from the bezel holder 41, when the lock member 51 was moved to a position in which the stopper part 55 engages with the lock part 38. Similarly, as shown in FIG. 11, the back face cover part 16*e* is provided so as to cover the back face of the operation convex part 54 in the 6 o'clock side, which was protruded from the bezel holder 41, when the lock member 51 was moved to a position in which the stopper part 55 was separated from the lock part 38.

Therefore, there can be guarded such that, by the rear face cover part 16*d*, an object does not impinge against the operation convex part 53, which was protruded from the bezel holder 41, from its back side, and there can be guarded such that, by the rear face cover part 16*e*, the object does not impinge against the operation convex part 54, which was protruded from the bezel holder 41, from its back side. Accordingly, it is possible to suppress a false operation in which the operation convex parts 53, 54 are carelessly pushed-in at a use time of the wristwatch 10, or the like, and thus the lock member 51 is moved.

Additionally, in the bezel holder 41, side face cover parts 41*a*, 41*b* are monolithically formed. These side face cover parts 41*a* are provided left and right in one pair so as to cover side faces of the operation convex part 53 when this operation convex part 53 was protruded from the bezel holder 41. Similarly, the side face cover parts 41*b* are provided left and right in one pair so as to cover both side faces of the operation convex part 54 when this operation convex part 54 was protruded from the bezel holder 41. As shown in FIG. 10 and FIG. 11, upper faces of these side face cover parts 41*a*, 41*b* slantingly descend from the bezel holder 41.

Therefore, by the side face cover part 41*a*, there can be guarded such that the object does not impinge against the operation convex part 53, which was protruded from the bezel holder 41, from a direction other than its upper side and back side and, by the side face cover part 41*b*, there can be guarded such that the object does not impinge against the operation convex part 54, which was protruded from the bezel holder 41, from the direction other than its upper side and back side. Accordingly, it is possible to suppress the false operation in which the operation convex parts 53, 54 are carelessly pushed-in at the use time of the wristwatch 10, or the like, and thus the lock member 51 is moved.

The matters other than those explained above are the same as the first embodiment. Accordingly, also in this second embodiment, the actions explained already in the first embodiment are obtained, and it is possible to solve the expected problem of the present invention.

What is claimed is:

1. A timepiece comprising:

a case band in which there is formed a bezel disposition part surrounding a cover glass;

a bezel which is disposed in the bezel disposition part so as to be capable of rotation-operating in regard to the case band, and in which there are formed a positioning part comprising plural concave-convex portions juxtaposed, in a direction of the rotation, in a back face opposing to a bottom face of the bezel disposition part, and a lock part comprising plural concave-convex portions juxtaposed in the direction of the rotation;

a positioning means which is attached to the case band, which permits clockwise and counter clockwise rotations of the bezel, which is elastically engaged with and disengaged from the positioning part such that, when the rotation of the bezel is stopped, the bezel is held in that position;

a lock member which is disposed between the case band and a back face of the bezel so as to be movable in a diameter direction of the bezel, and which has one pair of operation convex parts alternately pushing-in-operated from an outer periphery side of the bezel for this movement, a stopper part inserted to and retracted from the lock part following upon the movement, and a holding part; and a holding means attached to the case band so as to be engaged with and disengaged from the holding part, and elastically engaging with the holding part when the lock member is moved to a position in which the stopper part engages with the lock part to thereby hold the lock member.

2. A timepiece according to claim 1, wherein an annular bezel holder holding an outer periphery part of the bezel from a front side is fixed to the case band, a guide groove is provided in a position corresponding to a diameter direction of the bezel holder, and the operation convex part is inserted to the guide groove and made protrusible from the bezel holder.

3. A timepiece according to claim 1, wherein the operation a convex part is disposed in a 12 o'clock-6 o'clock direction.

4. A timepiece according to claim 2, wherein the operation convex part protruded from the bezel holder is disposed in a 12 o'clock-6 o'clock direction.

5. A timepiece according to claim 3, wherein mutually different displays are applied to each of the operation convex parts.

6. A timepiece according to claim 4, wherein mutually different displays are applied to each of the operation convex parts.

7. A timepiece according to claim 1, wherein the positioning part and the lock part are continuously formed along a radial direction of the bezel.

8. A timepiece according to claim 2, wherein the positioning part and the lock part are continuously formed along a radial direction of the bezel.

9. A timepiece according to claim 3, wherein the positioning part and the lock part are continuously formed along a radial direction of the bezel.

10. A timepiece according to claim 4, wherein the positioning part and the lock part are continuously formed along a radial direction of the bezel.

11. A timepiece according to claim 5, wherein the positioning part and the lock part are continuously formed along a radial direction of the bezel.

12. A timepiece according to claim 6, wherein the positioning part and the lock part are continuously formed along a radial direction of the bezel.

13. A timepiece according to claim 1, wherein the positioning means is formed by a first click member comprising a spherical body and engaged with and disengaged from the positioning part, and a biasing body for a click, which rotatably supports this first click member and pushes it to the back face of the bezel.

14. A timepiece according to claim 2, wherein the positioning means is formed by a first click member comprising a spherical body and engaged with and disengaged from the positioning part, and a biasing body for a click, which rotatably supports this first click member and pushes it to the back face of the bezel.

15. A timepiece according to claim 1, wherein the holding part is formed by a groove or a hole, opening to a back face of the lock member, and the holding means is formed by a second click-member comprising a spherical body and engaged with and disengaged from the holding part, and a biasing body for holding, which rotatably supports this second click member and pushes it to the back face of the lock member.

16. A timepiece according to claim 2, wherein the holding part is formed by a groove or a hole, opening to a back face of the lock member, and the holding means is formed by a second click member comprising a spherical body and engaged with and disengaged from the holding part, and a biasing body for holding, which rotatably supports this second click member and pushes it to the back face of the lock member.

17. A timepiece according to claim 1, wherein in the lock member there is provided other holding part which is formed by a groove or a hole, opening to the back face of the lock member, and with which the holding means is engaged when the lock member is moved to a position in which the stopper part is separated from the lock part.

18. A timepiece according to claim 1, wherein the positioning part and the positioning means are provided near an inner periphery of the bezel, and the lock part and the holding means are provided near an outer periphery of the bezel.

19. A timepiece according to claim 2, wherein a back face cover part covering a back face of the operation convex part protruded from the bezel holder is monolithically provided in the case band.

20. A timepiece according to claim 2, wherein side face cover parts covering both-side faces of the operation convex part protruded from the bezel holder are monolithically provided in the bezel holder.

* * * * *